US005242244A

United States Patent [19]

Dockery

[11] Patent Number: 5,242,244

[45] Date of Patent: Sep. 7, 1993

[54] AQUATIC CONTROL SLEEVE APPARATUS

[76] Inventor: Daryl Dockery, P.O. Box 168, Highway 90 W., Ponce de Leon, Fla. 32455

[21] Appl. No.: 897,324

[22] Filed: Jun. 11, 1992

[51] Int. Cl.[5] ..... E02B 3/00

[52] U.S. Cl. ..... 405/52; 405/60; 405/80

[58] Field of Search ..... 405/15, 21, 36, 52, 405/60, 80, 107, 115

[56] References Cited

U.S. PATENT DOCUMENTS

| | | | |
|---|---|---|---|
| 3,151,463 | 10/1964 | Talbott | 405/52 |
| 4,056,936 | 11/1977 | Mayer | 405/258 |
| 4,231,873 | 11/1980 | Swigger | 210/170 |
| 4,298,295 | 11/1981 | Bozzo et al. | 405/52 |
| 4,358,218 | 11/1982 | Graham | 405/60 |
| 4,498,806 | 2/1985 | Szonnell | 405/34 |
| 4,518,280 | 5/1985 | Fletcher | 405/17 |
| 4,607,981 | 8/1986 | van Klinken | 405/52 |
| 4,688,024 | 8/1987 | Gadde | 340/550 |
| 4,824,284 | 4/1989 | Akai | 405/52 X |
| 4,881,847 | 11/1989 | Sandels | 405/52 |
| 4,902,430 | 2/1990 | Peterson | 210/747 |

*Primary Examiner*—David H. Corbin
*Attorney, Agent, or Firm*—Gifford, Groh, Sprinkle, Patmore and Anderson

[57] ABSTRACT

An aquatic control sleeve apparatus for enabling application of chemical agents to underwater aquatic vegetation accumulating in a body of flowing water and a method for enabling application of the same. The aquatic control sleeve apparatus has an aquatic control sleeve placeable within a body of flowing water substantially parallel to its normal flow path. A first collar attached to the upstream end of the aquatic control sleeve funnels the entire flow of water into the aquatic control sleeve. The water surrounding the aquatic control sleeve is stilled or pacified by the funnelling of the moving water into the aquatic control sleeve, thus permitting the application of chemical agents to the stilled water to treat underwater vegetation without the fear of the chemical agents being swept away by the water current. A second collar is provided at the downstream end of the aquatic control sleeve and discharges the water funnelled through the aquatic control sleeve. The second collar prevents a backwash which would disturb the stillness of the water on the outside of the aquatic control sleeve. In an alternative embodiment, an inflatable bladder assembly is provided which fits into the mouth of an underwater spring. The bladder assembly directs the water flowing from the underwater spring into the aquatic control sleeve. A method for permitting the application of chemical agents to the underwater aquatic vegetation is also provided.

11 Claims, 2 Drawing Sheets

Fig-2
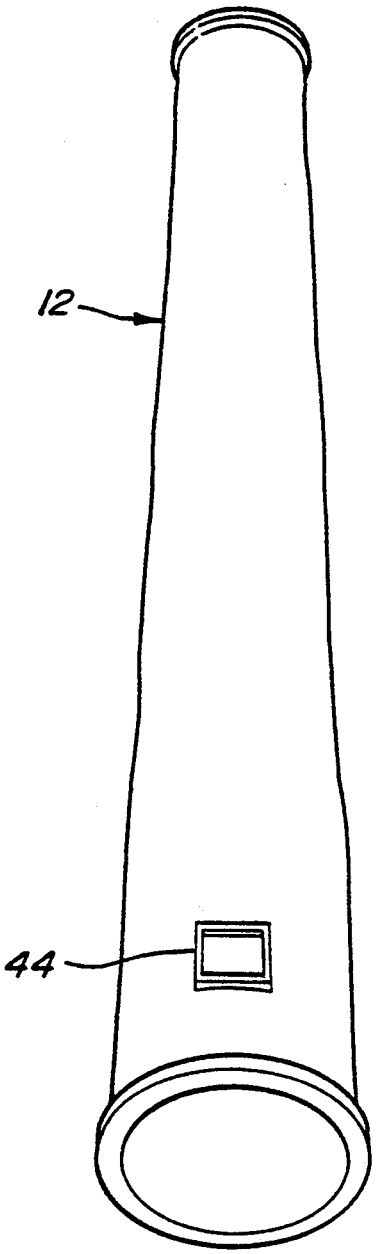
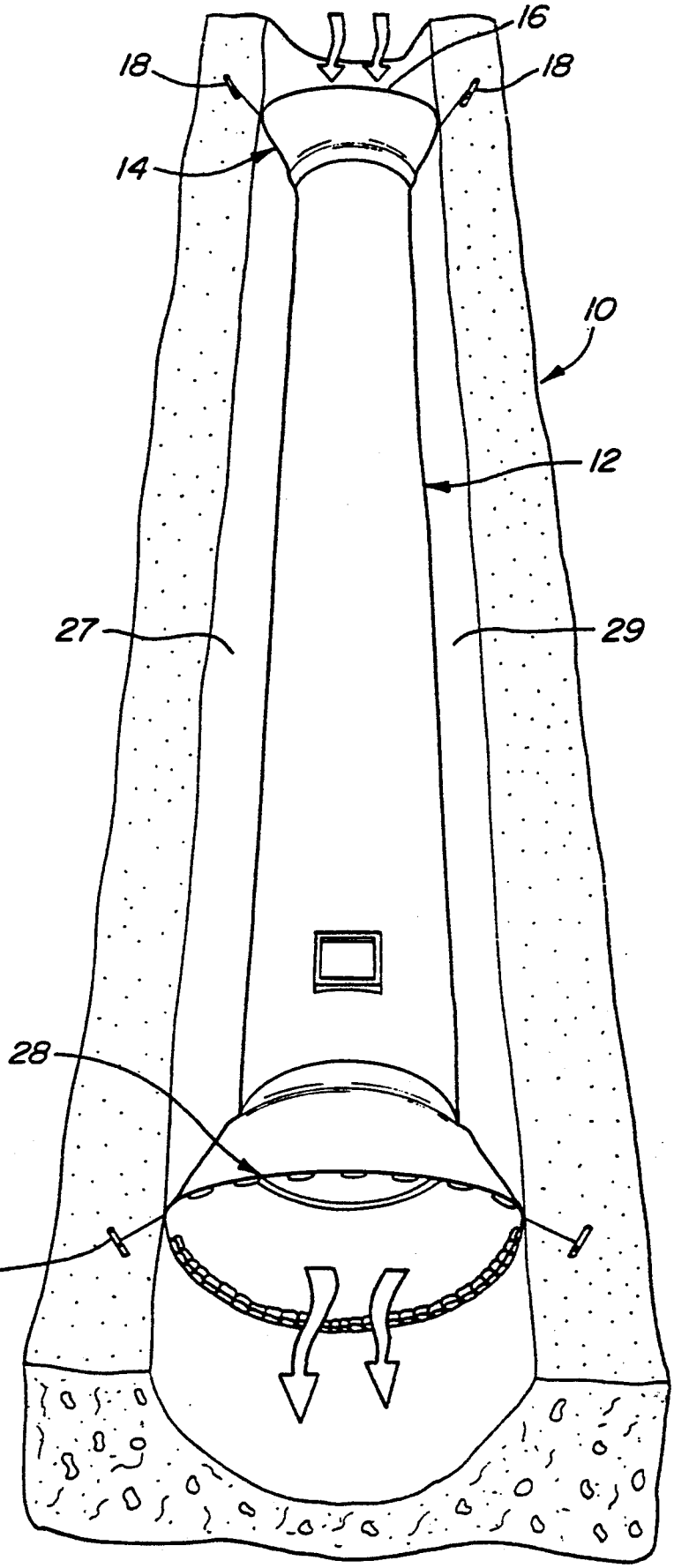
Fig-1

AQUATIC CONTROL SLEEVE APPARATUS

BACKGROUND OF THE INVENTION

1. Field of the Invention

The present invention relates to an aquatic control sleeve, and more particularly to an aquatic control sleeve for stilling a body of normally flowing water to enable chemical treatment of plant life accumulations.

2. Description of the Prior Art

A recurring problem in the utilization of commercial and recreational waterways is the uncontrolled growth of underwater aquatic vegetation. The introduction of herbicidal chemical agents to control underwater aquatic vegetation is well known in the art. However, in the case of a flowing stream or flowing body of water, the herbicides do not have sufficient time to act upon the aquatic vegetation before being carried downstream by the active current. Absent any means for removing an active current from an otherwise flowing body of water, the addition of chemical agents will not be able to control the underwater vegetation.

SUMMARY OF THE PRESENT INVENTION

The present invention provides an aquatic control sleeve for stilling a portion of a stream or flowing body of water enabling application of chemical agents to underwater aquatic vegetation and a method for enabling application of the same which overcomes the above-mentioned disadvantages of the prior art devices.

The aquatic control sleeve apparatus of the present invention has an elongated sleeve constructed of a nylon or durable plastic which is horizontally placeable within a body of flowing water. The sleeve is in the form of a long cylindrical tube which is insertable within a body of water. Weighting means are provided to anchor the aquatic control sleeve within the body of water. The weighting means may commonly take the form of an anchor or a plurality sandbags placed within the mouth of the aquatic control sleeve to secure communication of it to the bed of the body of water.

The aquatic control sleeve of the present invention provides a means for funnelling the active current of a body of normally flowing water into the cylindrical tube. In a situation where the active current in the body of water originates from an underwater spring, the aquatic control sleeve has a bladder assembly attached to its upstream end. The inflatable bladder has a first inflatable pouch which fits within the mouth of the underwater spring and directs the water flow from the spring into the inlet of the aquatic control sleeve. A second pouch of the inflatable bladder has a metal strip which functions as a radial support for the inflatable pouch in the underwater area inside the mouth of the spring.

As is often the case, a free-flowing current may exist across the entire width of the body of flowing water. To still a portion of such a body of flowing water, the aquatic control sleeve of the present invention alternatively has a first collar, attached to the upstream end of the cylindrical tube, extending between opposing shores of the body of flowing water. The first collar also extends from the surface of the body of water to the bed. As a result, the entire current flow of the body of water is funnelled into the aquatic control sleeve. The aquatic control sleeve has a generally smaller cross-sectional area than the cross-sectional area of the inlet of the first collar. The funnelling of the entire current flow causes the water exterior to the aquatic control sleeve to become still.

A second collar is provided at the downstream end of the aquatic control sleeve and generally has a like structure and a cross-sectional area as the first collar. The purpose of the second collar is to discharge the current originating in either the underwater spring or along the body of water in such a manner that it does not cause a backwash which would affect the stillness of the water within the region of the aquatic control sleeve. In this manner, chemical additives may be applied to the stilled water to kill the underwater vegetation and the chemical additives will not be carried away by the active water flow bypassed through the aquatic control sleeve of the present invention.

A method for enabling the application of chemical agents to underwater aquatic vegetation is also provided. The method includes the steps of inserting an aquatic control sleeve in a substantially horizontal manner within the body of flowing water, funneling the active current of the body of flowing water to still the active current within the body of water exterior of the aquatic control sleeve and applying a chemical agent to the stilled water to eliminate the undesired underwater aquatic vegetation.

BRIEF DESCRIPTION OF THE DRAWINGS

A better understanding of the present invention will be had upon reference to the following detailed description, when read in conjunction with the accompanying drawings, wherein like reference characters refer to like parts throughout the several views, and in which:

FIG. 1 is a perspective view showing a primary embodiment of the present invention;

FIG. 2 is an overall perspective of the aquatic control sleeve of the present invention;

DETAILED DESCRIPTION OF THE PREFERRED EMBODIMENT OF THE PRESENT INVENTION

Referring to FIG. 1, a preferred embodiment of the aquatic control sleeve apparatus 10 is shown. The aquatic control sleeve apparatus 10 has an aquatic control sleeve 12 which is horizontally placeable within a body of normally flowing water. The aquatic control sleeve 12, shown in FIG. 2, is constructed of a nylon or other durable material and is waterproof. The aquatic control sleeve 12 assumes the shape of a hollow cylindrical tube when inserted within the body of flowing water.

Figure 3:
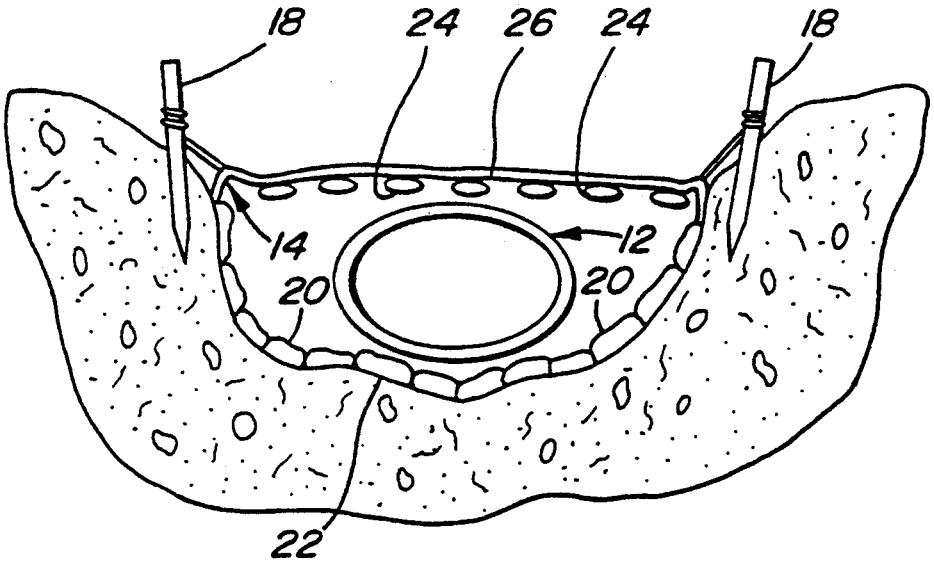
FIG. 3 is a frontal view of the primary embodiment of the present invention.

A first collar 14 attaches to an upstream end of the aquatic control sleeve 12 by a clamp or other appropriate means known in the art. The first collar 14 is constructed of a material similar to that used in the aquatic control sleeve 12. The first collar 14 has a mouth 16 which extends the entire width and depth of the body of flowing water. Means such as stakes 18 are employed to secure edges of the mouth 16 of the first collar 14 to the opposing shores of the body of water. Weighting means, such as sandbags 20, may be used to hold the lower surface 22 of the mouth 16 of the first collar 14 to the bed of the body of water as shown in FIG. 3. Floats 24 are attached to the upper surface 26 of the mouth 16 of the first collar 14 to keep the upper surface 26 of the mouth 16 above the surface of the flowing body of water. The first collar 14 funnels the water into the aquatic control sleeve 12 and prevents any of the water from flowing in the collateral region external to the aquatic control sleeve 12. The cross-section area of the aquatic control sleeve 12 is considerably smaller than the cross-sectional area of the mouth 16 of the first collar, yet the aquatic control sleeve is capable of transporting the entire quantity of water in the body flowing in the body of normally flowing water in an orderly and continuous fashion.

A second collar 28 is provided at a second or downstream end of the aquatic control sleeve. The second collar 28 has characteristics identical to that of the first collar and extends from shore to shore and along the bottom of the body of water. The purpose of the second collar 28 is to prevent a backwash of the water discharged from aquatic control sleeve 12 from disturbing the overall stillness of the bodies of water 27 and 29 exterior to the aquatic control sleeve between the first and second collars 14 and 28 respectively. While the aquatic control sleeve 12 is in place, chemical agents may be added to the stilled water exterior the sleeve in order to treat and/or remove undesired underwater aquatic vegetation.

Figure 4:
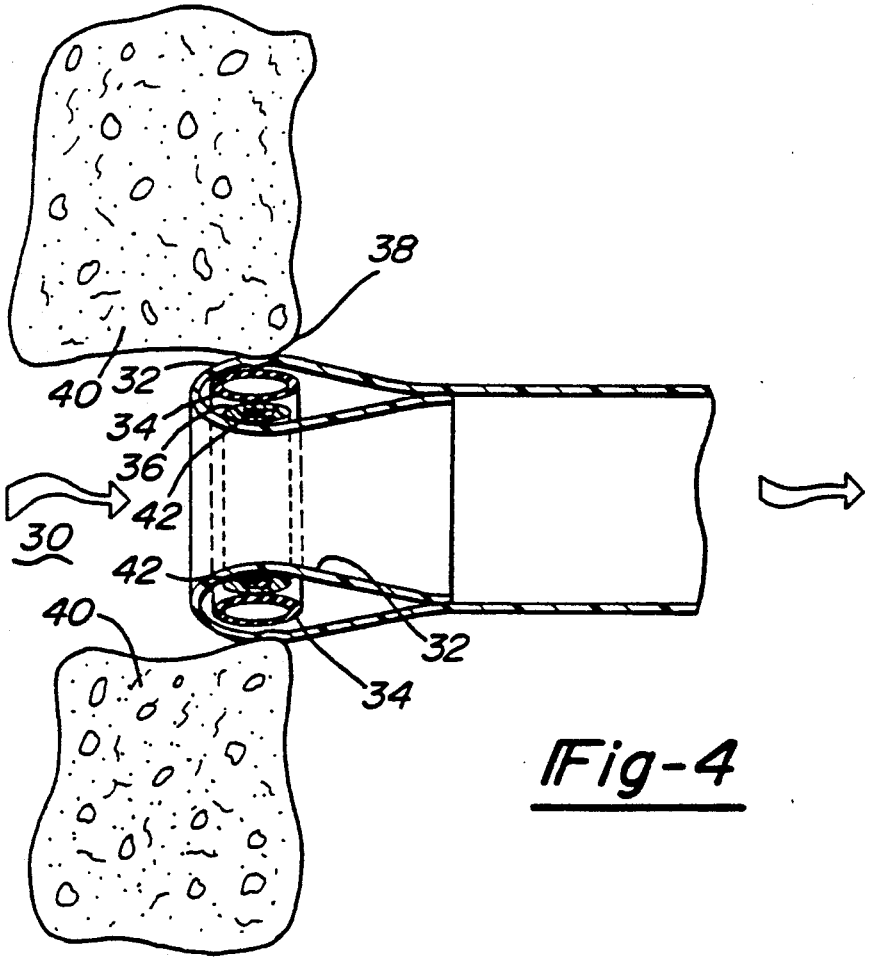
FIG. 4 is a sectional view of an alternative embodiment of the present invention.

Referring to FIG. 4, an alternate embodiment of the present invention is shown. In contrast to the above scenario which contemplates free-flowing currents across the entire width of the body of water, FIG. 4 is directed to a situation where the current in the body of water originates from an underwater spring 30 or other opening through which the water is introduced. In this embodiment, a bladder assembly 32 rather than the first collar 14 is attached to the upstream end of the aquatic control sleeve 12. The bladder assembly 32 has a first and a second annular pouch 34 and 36 respectively. The first pouch 34 functions as an inflatable bladder which fits inside the mouth 38 of the underwater spring 30. The first pouch 34 expands to engage the sidewalls of the mouth 38 of the spring 30. The second annular pouch 36 is circumscribed by the first pouch 34 and encloses metal strip 42. The diameter of the metal strip 42 is less than the diameter of the mouth 38 of the spring 30. The annular metal strip 42 provides a radial support for the first pouch 34 such that the expansion of the first pouch 34 is in a radial direction. When the first pouch 34 is inflated by pressurized water, it will expand to sealingly engage the internal walls 40 at the mouth of the spring 30 in a watertight manner. The sealing of first pouch 34 against the walls 40 of the spring 30 prevents the water flow from the spring 30 from being discharged outside the aquatic control sleeve 12. The bladder assembly 32 directs the water from the spring 30 into the aquatic control sleeve 12 in much the same manner as the first collar 14 indicated above. Conventional securing means, such as a U-nail, connect the inflatable bladder assembly 32 to the aquatic control sleeve 12. The inflatable bladder assembly 32 is commonly constructed of a nylon or other durable material consistent with the construction of the aquatic control sleeve 12. A layer of material surrounds and encloses both the first and second pouches 34 and 36 respectively. The embodiment of the present invention, which utilizes the inflatable bladder assembly 32 at the upstream end, also utilizes the second collar 28 at the second or downstream end of the aquatic control sleeve 12 in order to prevent a backwash of current during the chemical additive process.

A plurality of aquatic control sleeves may be employed end-to-end in order to permit chemical treatment of underwater vegetation over an extended length of the body of flowing water. The aquatic control sleeves 12 may be interconnected by means known in the art such as the U-nail indicated above. Additional aquatic control sleeves may be provided which communicate with a common aquatic control sleeve. This arrangement is desirable where there is more than a single underwater spring.

Referring to FIG. 2, an access port 44 may be provided in the aquatic control sleeve 12 to permit withdrawal of water for irrigation or other purposes during operation. The body of water exterior to the aquatic control sleeve 12 is accordingly stilled in order to permit application of chemical additives to the stilled water and the underwater vegetation.

A method for enabling application of chemical agents to underwater aquatic vegetation is discussed herebelow. The method includes the steps of inserting an aquatic control sleeve apparatus 10 in a substantially horizontal manner within the body of flowing water, funnelling the active current of the body of flowing water into the aquatic control sleeve apparatus to still the water external to the aquatic control sleeve, and applying a chemical agent to the stilled water in order to treat or remove the underwater aquatic vegetation in a desired manner.

Having described my invention, many embodiments will become apparent to those skilled in the art to which it pertains

I claim:

1. An aquatic control sleeve apparatus for enabling application of chemical agents to kill underwater aquatic vegetation accumulating in a body of flowing water, said aquatic control sleeve comprising:

an aquatic control sleeve insertable in said body of flowing water, said aquatic control sleeve having an open upstream end and an open downstream end;

means for securing said aquatic control sleeve generally parallel to the direction of flow of water in said body of flowing water; and means attached to said upstream end of said aquatic control sleeve for channeling said flowing water therethrough to still the water exterior to said aquatic control sleeve.

2. The aquatic control sleeve apparatus as described in claim 1, wherein said means for channelling said flowing water through said aquatic control sleeve comprises an inflatable bladder assembly placeable in an opening of an underwater spring causing said water flowing from said spring into said aquatic control sleeve.

3. The aquatic control sleeve apparatus as described in claim 2, wherein said inflatable bladder assembly comprises an annular inflatable pouch, an inner pouch and a radial support member disposed in said inner pouch.

4. The aquatic control sleeve apparatus as described in claim 3, wherein said inner pouch is a nylon covering surrounding said radial support member.

5. The aquatic control sleeve apparatus as described in claim 4, wherein radial support member is a metal strip enclosed in said second pouch, said annular metal strip forming a diameter slightly smaller than the diameter of said opening of said underwater spring.

6. The aquatic control sleeve apparatus as described in claim 1, wherein said means for channelling said flowing water through said aquatic control sleeve comprises a first collar extending between opposing shores of said body of flowing water, said first collar funnelling the entire current flow of the body of flowing water current into said upstream end of said aquatic control sleeve.

7. The aquatic control sleeve apparatus as described in claim 6, wherein a second collar extending between opposing shores of the body of flowing water is attached to said downstream end of said aquatic control sleeve to prevent a backwash of said water into the region on either side of said aquatic control sleeve between said first and second collars.

8. The aquatic control sleeve apparatus as described in claim 1, further comprising an access port provided in said aquatic control sleeve, said access port enabling the withdrawal of water from within said aquatic control sleeve for at least irrigation purposes.

9. The aquatic control sleeve apparatus as described in claim 2, wherein additional said aquatic control sleeves are provided for channelling water flowing from additional underwater springs into said first recited aquatic control sleeve.

10. The aquatic control sleeve apparatus as described in claim 6, wherein said means for securing said aquatic control sleeve apparatus in said body of water comprises at least a plurality of weighted members placeable inside said first and second collars to secure said first and second collars to the bed of said body of flowing water.

11. A method for stilling a portion of a body of flowing water to enable application of chemical agents to underwater aquatic vegetation comprising the steps of:

inserting an aquatic control sleeve within said body of flowing water substantially parallel to the normal flow path of said body of flowing water;

funnelling said body of flowing water into said aquatic control sleeve to still the water on the outside of said aquatic control sleeve; and applying a chemical agent to said stilled water to kill the underwater aquatic vegetation in a desired manner.

* * * * *